US010361496B1

(12) United States Patent
Weiland et al.

(10) Patent No.: US 10,361,496 B1
(45) Date of Patent: Jul. 23, 2019

(54) CONDUCTOR ASSEMBLY WITH A CRIMPED TUBULAR FERRULE AND METHOD AND TOOL FOR MANUFACTURING SAME

(71) Applicant: Delphi Technologies, LLC, Troy, MI (US)

(72) Inventors: Jesse Weiland, Hermitage, PA (US); Shae T. McGarvey, Leola, PA (US); Ryan D. Lewis, Warren, OH (US); John Kountz, Youngstown, OH (US)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 16/019,666

(22) Filed: Jun. 27, 2018

Related U.S. Application Data

(63) Continuation-in-part of application No. 15/935,375, filed on Mar. 26, 2018, and a continuation-in-part of application No. 15/980,055, filed on May 15, 2018.

(51) Int. Cl.

| | |
|---|---|
| ***B21D 41/00*** | (2006.01) |
| ***H01R 9/05*** | (2006.01) |
| ***H01R 43/058*** | (2006.01) |
| ***H01B 17/38*** | (2006.01) |

(52) U.S. Cl.
CPC ..... *H01R 9/0518* (2013.01); *H01B 17/38* (2013.01); *H01R 43/058* (2013.01)

(58) Field of Classification Search
CPC .... B21J 7/14; B21F 1/00; B21B 19/04; B21D 15/04
USPC ..... 72/402, 403, 367.1, 370.21
See application file for complete search history.

(56) References Cited

U.S. PATENT DOCUMENTS 8,827,744 B2 * 9/2014 Poma ..... H01R 4/20 439/585

* cited by examiner

*Primary Examiner* — Phuong Chi T Nguyen
(74) *Attorney, Agent, or Firm* — Robert J. Myers

(57) ABSTRACT

A cable assembly includes an elongate conductor surrounded by an outer insulator and an outer ferrule surrounding a portion of the conductor. An outer surface of the outer ferrule is deformed to produce an indentation having an indentation surface that is angled relative to the outer surface. The indentation forms a barb that at least partially penetrates the outer insulator. A method of manufacturing the cable assembly and a tool for forming the outer ferrule is also presented and described.

17 Claims, 11 Drawing Sheets

CONDUCTOR ASSEMBLY WITH A CRIMPED TUBULAR FERRULE AND METHOD AND TOOL FOR MANUFACTURING SAME

CROSS-REFERENCE TO RELATED APPLICATION

This application is a continuation-in-part application and claims the benefit under 35 U.S.C. § 120 of U.S. patent application Ser. No. 15/980,055, filed May 15, 2018 and U.S. patent application Ser. No. 15/935,375, filed Mar. 26, 2018, the entire disclosure of each of which is hereby incorporated by reference.

TECHNICAL FIELD OF THE INVENTION

The invention generally relates to a conductor assembly particularly a conductor assembly including a tubular ferrule.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Presented herein is a conductor assembly that includes a seamless tubular ferrule that is crimped to an elongate conductor. The tubular ferrule is deformed in a crimping process to attach the ferrule to the conductor. After crimping, the ferrule defines four depressions having a consistent radius and four protrusions evenly spaced about a circumference of the ferrule. A tool used to deform the ferrule which limits the height four protrusions is also presented herein.

Figure 1:
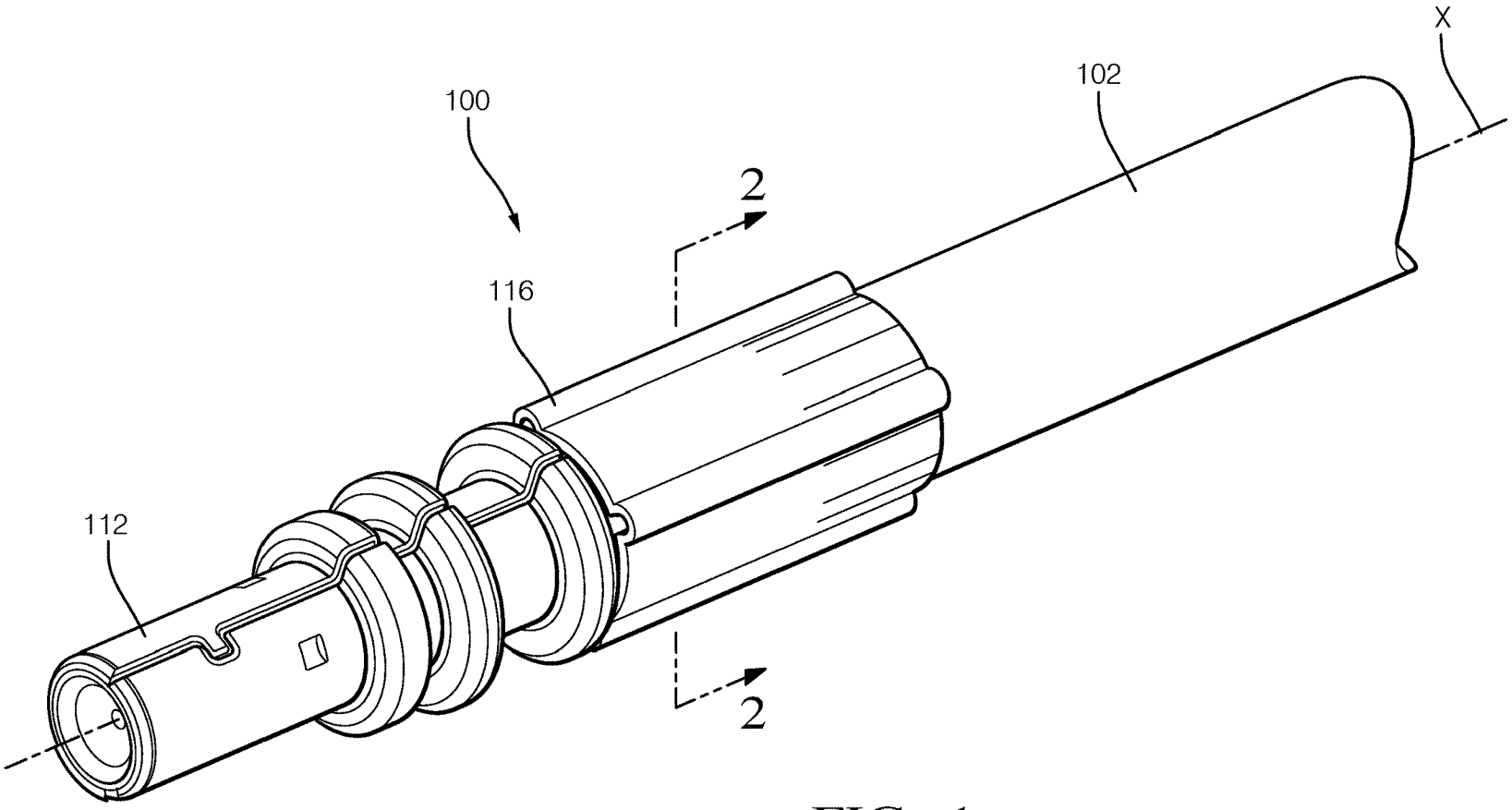
FIG. 1 is a perspective view of a conductor assembly including a crimped tubular ferrule according to one embodiment.
Figure 2:
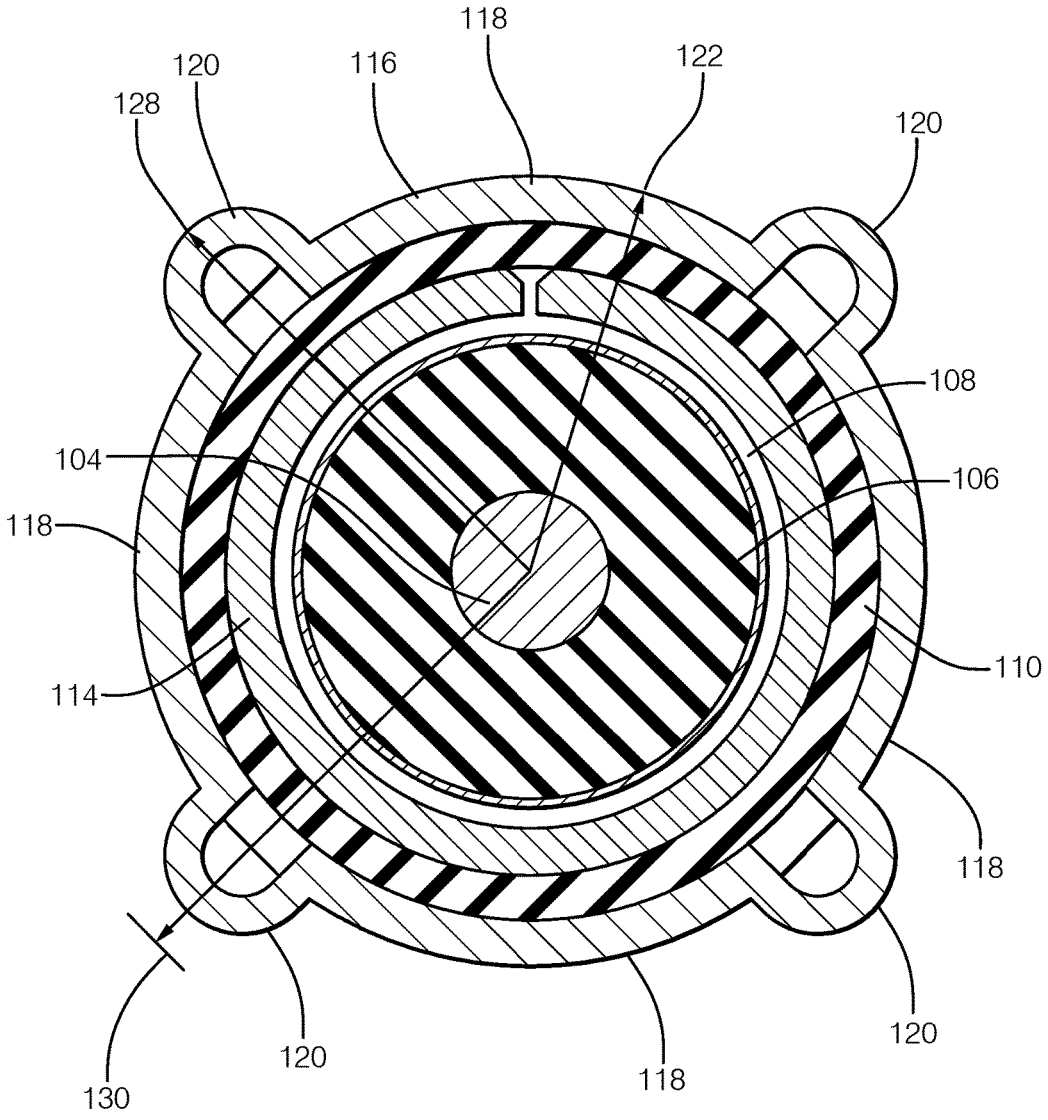
FIG. 2 is a cross section view of the conductor assembly of FIG. 1 according to one embodiment.
Figure 3:
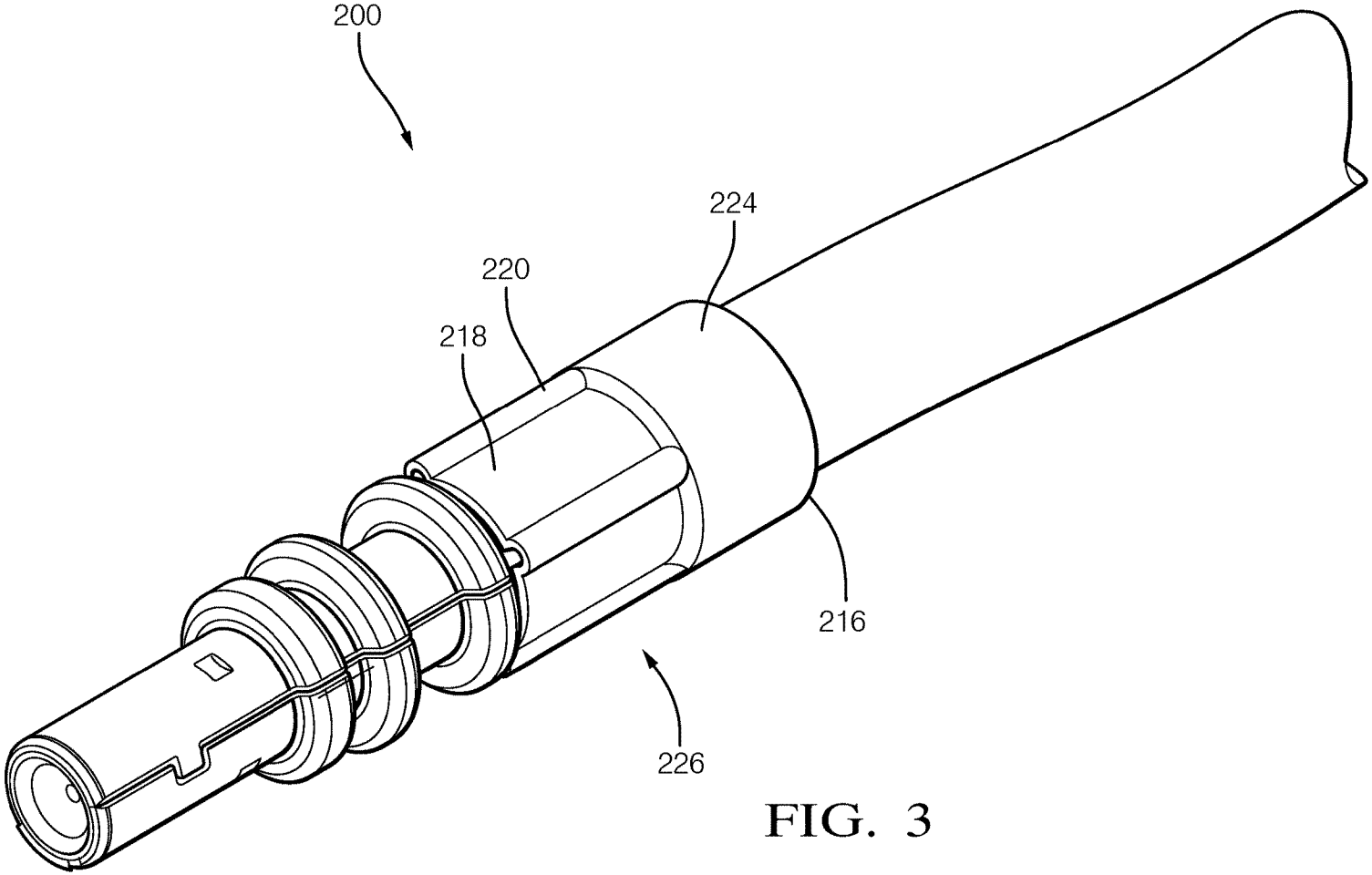
FIG. 3 is a perspective view of a conductor assembly including a crimped tubular ferrule according to one embodiment.

FIGS. 1-3 illustrate a non-limiting example of a conductor assembly 100, hereinafter referred to as the assembly 100. As shown in FIG. 3, the assembly 100 includes an elongate conductor, in this particular example a coaxial electrical cable 102. The coaxial cable 102 has a central inner conductor 104, an inner insulator 106 surrounding the inner conductor 104, an outer conductor 108 surrounding the inner insulator 106, and an outer insulator 110 surrounding the inner insulator 106. As shown in FIG. 2, the coaxial cable 102 has a generally circular cross section.

The assembly 100 also includes a conductive inner terminal (not shown) connected to the inner conductor 104 and a conductive outer terminal 112 surrounding the inner terminal and connected to the outer conductor 108. The outer terminal 112 defines a tubular inner ferrule 114 that is disposed intermediate the inner insulator 106 and the outer insulator 110. According to the particular example illustrated in FIG. 2, the inner ferrule 114 is located intermediate the outer insulator 110 and the outer conductor 108. A terminal insulator is disposed between the inner terminal and the outer terminal 112.

The assembly 100 further includes a generally cylindrical seamless outer ferrule 116 having a surrounding a portion of the outer insulator 110 overlying the inner ferrule 114. The outer ferrule 116 is deformed by a crimping tool 300 to define four depressions 118 extending along the outer ferrule 116 in a direction generally parallel to the longitudinal axis X of the outer ferrule 116. Each of the four depressions 118 have the same consistent depression radius 122. The deformation produces four protrusions 120 extending along the outer ferrule 116 in a direction generally parallel to the longitudinal axis of the outer ferrule 116. The four depressions 118 and the four protrusions 120 are evenly spaced about a circumference of the outer ferrule 116. Adjacent depressions 118 of the four depressions 118 are spaced approximately 90 degrees apart about the longitudinal axis of the outer ferrule 116. As used herein, approximately 90 degrees apart is within a range of 80 to 100 degrees apart. As best shown in FIG. 2, one of the four protrusions 120 is located intermediate the adjacent depressions 118. Adjacent protrusions 120 of the four protrusions 120 are also spaced approximately 90 degrees apart about the longitudinal axis of the outer ferrule 116. As shown in FIGS. 9*a* and 9*b*, the depression radius 122 of the four depressions 118 is less than the original ferrule radius 124 of the outer ferrule 116 prior to deformation by the crimping tool 300.

The height 128 of each of the four protrusions 120 is controlled during the crimping process 700 so that each of the four protrusions 120 is equal to or less than a height threshold 130. Control of the protrusion height 128 is discussed in more detail in the description of the crimping tool 300 below.

As shown in FIG. 1, the four depressions 118 and the four protrusions 120 extend along the entire length of the outer ferrule 116. According to an alternative embodiment of the assembly 200 shown in FIG. 3, only a central portion 226 of the outer ferrule 216 is deformed to form the four depressions 218 and the four protrusions 220. The ends of the outer ferrule 216 retain the original ferrule radius 224.

Figure 4:
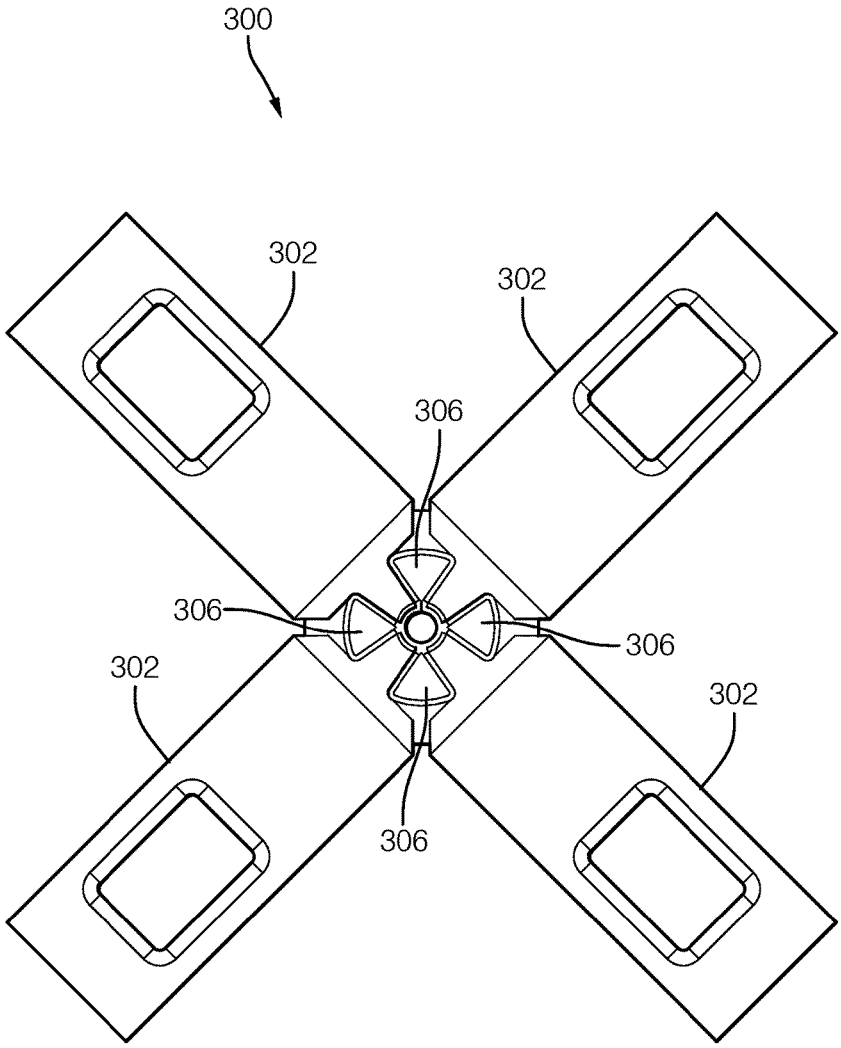
FIG. 4 is a front end view of a crimping tool having fixed limiting dies used to form the tubular ferrule of the conductor assembly of FIG. 1 or 3 according to one embodiment.
Figure 5:
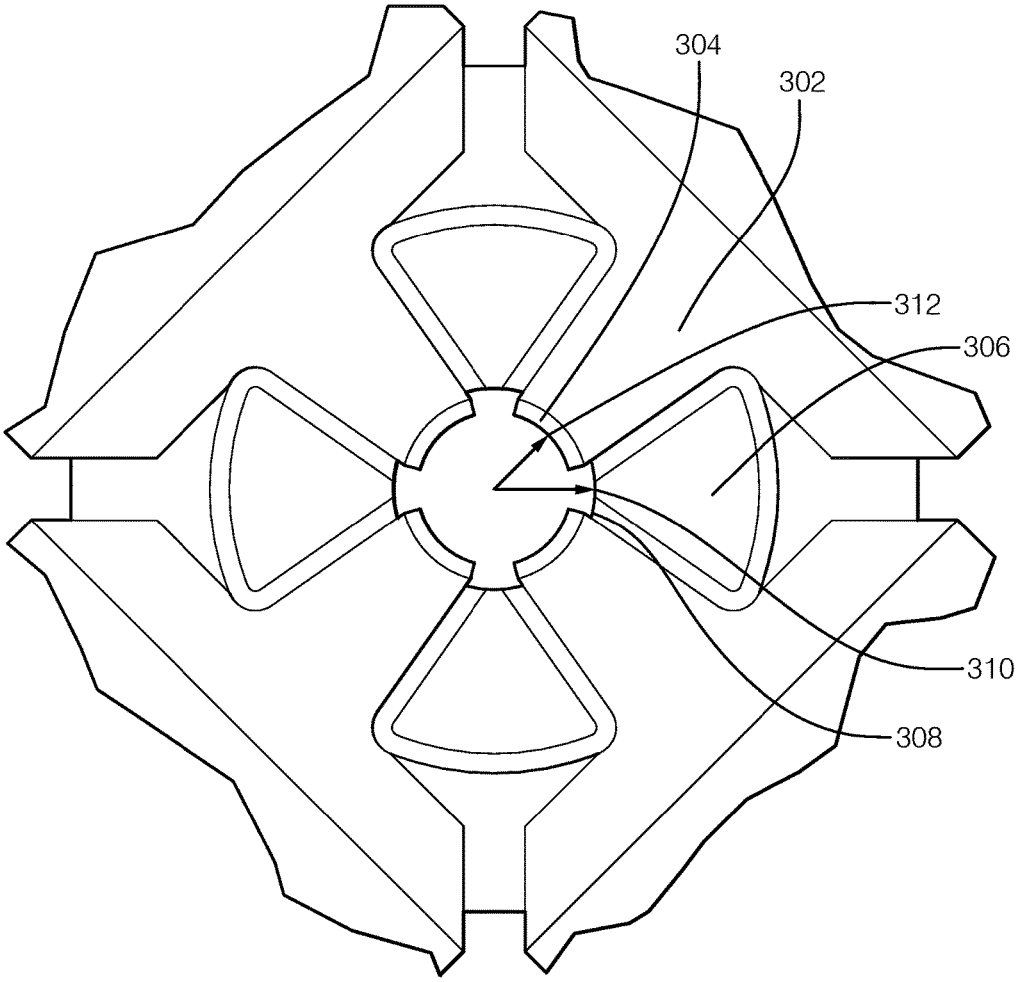
FIG. 5 is a close up front end view of the crimping dies and limiting dies of the crimping tool of FIG. 4 according to one embodiment.
Figure 6:
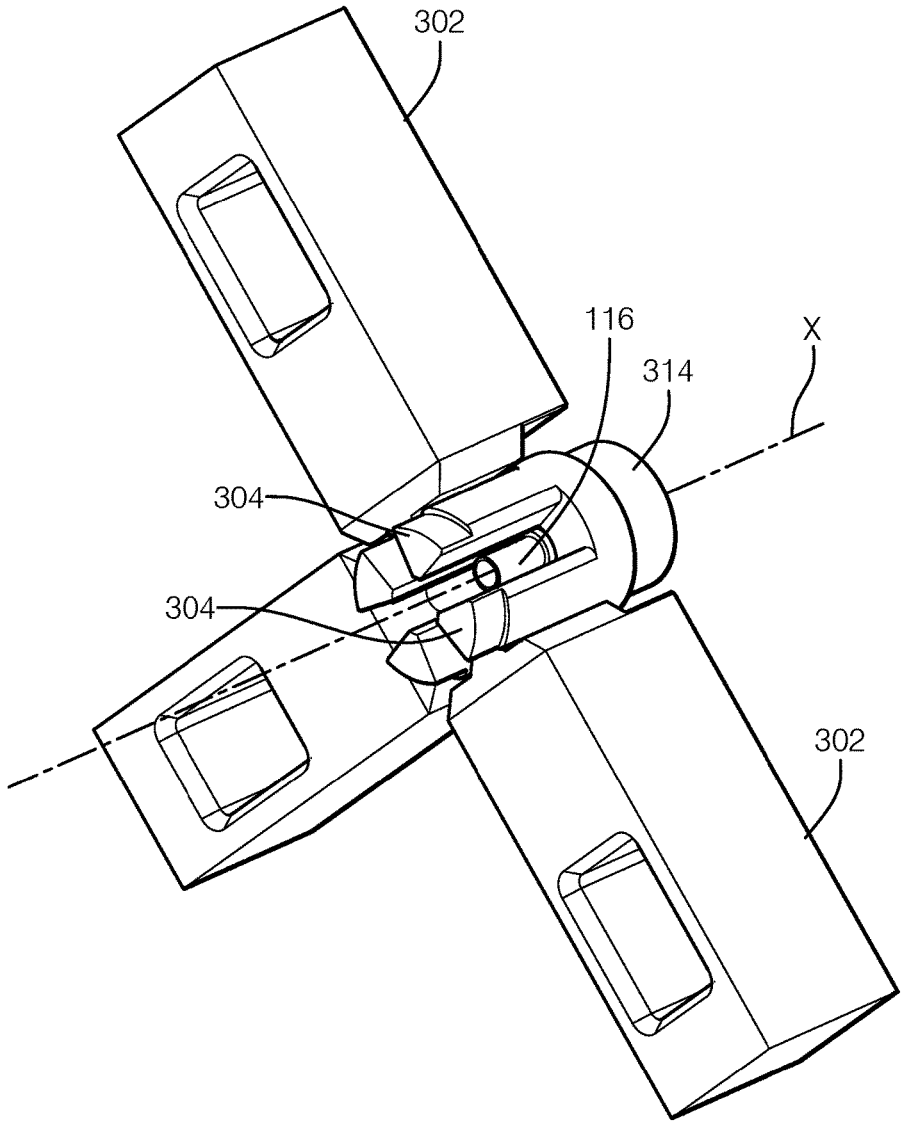
FIG. 6 is a perspective side view of the crimping tool of FIG. 4 with one of the crimping dies removed to better show the limiting dies according to one embodiment.

FIGS. 4-6 illustrate a non-limiting example of a crimping tool 300 used to crimp the outer ferrule 116, 216 of the coaxial cable assembles 100, 200 shown in FIGS. 1 and 3. The crimping tool 300 is configured to form the four evenly spaced depressions 118, 218 and the four evenly spaced protrusions 120, 220 about the circumference of the outer ferrule 116. As shown in FIG. 4, the crimping tool 300 includes four crimping dies 302. Each crimping die 302 of the four crimping dies 302 defines a concave crimping surface 304 having an depression radius 312 that is substantially equal to the depression radius 122 of the formed outer ferrule 116. The crimping tool 300 also includes four limiting dies 306. As best shown in FIG. 5, each limiting die 306 defines a concave limiting surface 308 having a limiting radius 310 that is greater than the depression radius 312 of the crimping dies 302. The limiting dies 306 are configured to limit the height 128 of each protrusion to the height threshold 130 and are located intermediate two adjacent crimping dies 302 of the four crimping dies 302. Adjacent crimping dies 302 are spaced approximately 90 degrees apart about a longitudinal axis of the crimping tool 300. Adjacent limiting dies 306 of the four limiting dies 306 are also spaced approximately 90 degrees apart about the longitudinal axis of the crimping tool 300.

Each limiting surface 308 is spaced at a distance of the limiting radius 310 from the longitudinal axis of the ferrule. This limiting radius 310 is equal to the original ferrule radius 124 plus the height threshold 130 of the four protrusions 120 of the outer ferrule 116.

According to the embodiment of the crimping tool 300 shown in FIG. 6, the four limiting dies 306 are integrally formed in a single die assembly 314 and are fixed such that each limiting surface 308 remains at the distance of the limiting radius 310 as the four crimping dies 302 move relative to the longitudinal axis of the tool 300.

Figure 7:
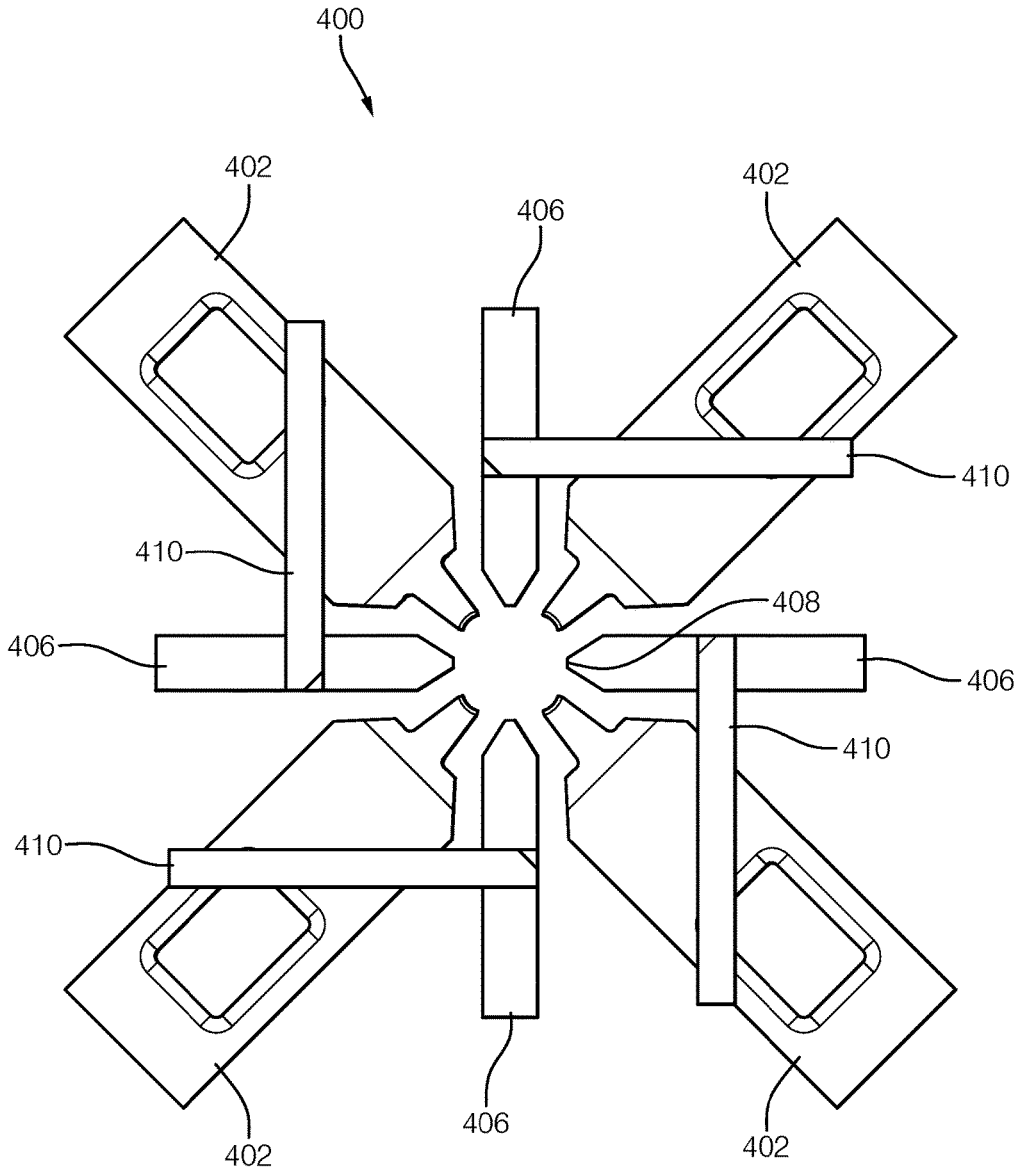
FIG. 7 is a front end view of a crimping tool having moveable limiting dies used to form the tubular ferrule of the conductor assembly of FIG. 1 or 3 according to one embodiment.

According to an alternative embodiment of the crimping tool 400 shown in FIG. 7, the crimping tool 400 further includes four linkages 410 between each crimping die 402 and an adjoining limiting die 406. The four linkages 410 are configured to move each limiting die 406 and hence each limiting surface 408 to the distance of the limiting radius 310 as the four crimping dies 402 move toward the longitudinal axis of the tool 400 as the crimping tool 400 deforms the outer ferrule 116 of the coaxial cable assembly 100.

Figure 8B:
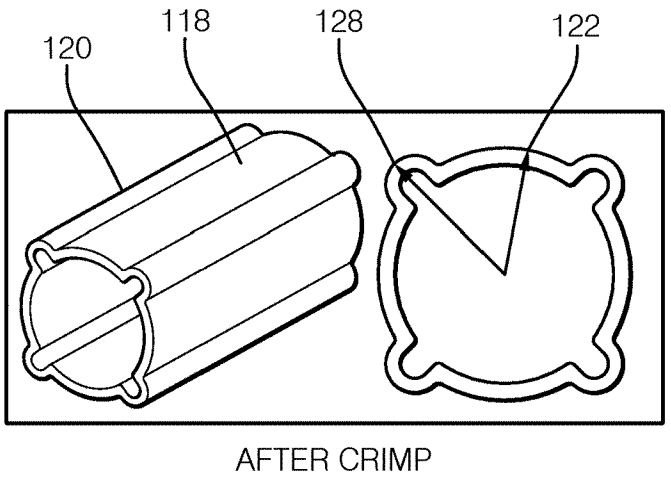
FIG. 8*b* is a perspective and end view of the tubular ferrule of the conductor assembly of FIG. 8*a* after forming with the crimping tool of FIG. 4 or 7 according to one embodiment.
Figure 8A:
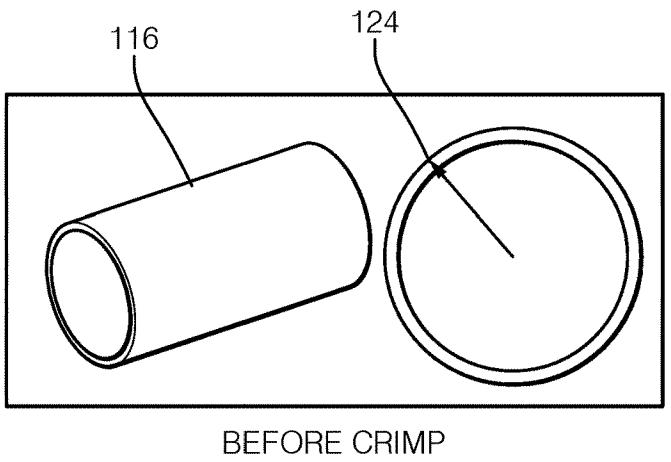
FIG. 8*a* is a perspective and end view of a tubular ferrule of the conductor assembly of FIGS. 1 and 3 prior to forming with the crimping tool of FIG. 4 or 7 according to one embodiment.

FIG. 8*a* illustrates the shape of the outer ferrule 116 prior to forming. FIG. 8*b* illustrate the shape of the outer ferrule 116 after forming it with the crimping tool 300, 400.

Figure 9:
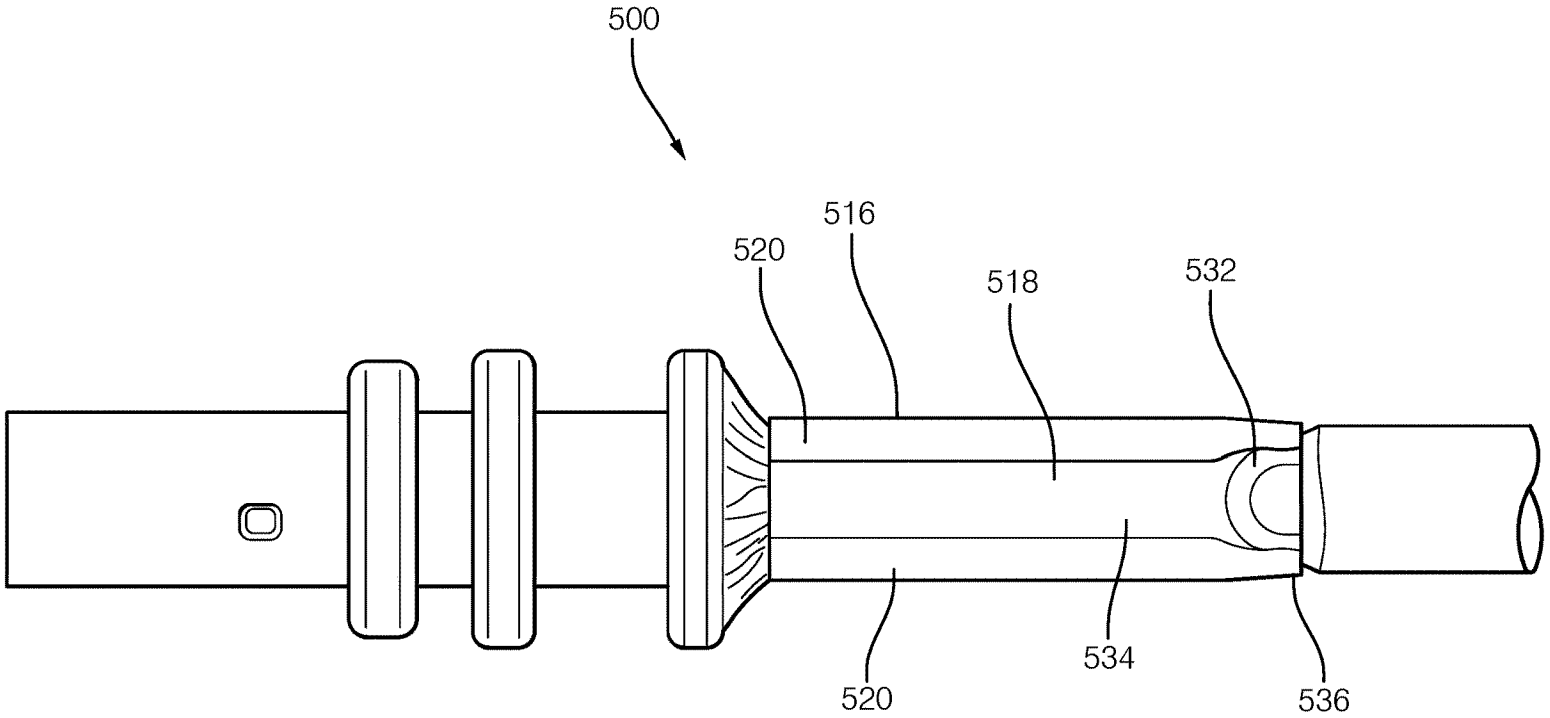
FIG. 9 is a side view of a conductor assembly including an indentation that forms a barb penetrating the outer insulator according to one embodiment.

FIG. 9 illustrates an alternative embodiment of the assembly 500 that includes four indentations 532 produced by deforming the convex bottom surfaces 534 of the four depressions 518. The indentations 532 are located adjacent a distal edge 536 of the outer ferrule 516. An angle of a surface of the indentation 532 relative to the convex bottom surfaces 534 is in a range of 10 to 20 degrees, preferably 15 degrees. Adjacent indentations 532 of the four indentations 532 are spaced approximately 90 degrees apart about the longitudinal axis X of the outer ferrule 516. The inventors have confirmed through testing that the addition of the indentations 532 improve the integrity of the assembly 500 by increasing the force required to separate the outer ferrule 516 from the assembly 500. Tables 1 and 2 present a comparison of test results regarding the performance of assembly 100 and assembly 500 during USCAR 37 Shield Retention tests and USCAR 17 Sequence N—Mechanical Pull tests published by the United States Council for Automotive Research (USCAR).

TABLE 1

USCAR 37 Shield Retention Test Results

| | Assembly 100 | Assembly 500 |
|---|---|---|
| # of Samples | 80 | 6 |
| Max. Force Required to Separate Outer Ferrule | 151.9 N | 275.8 N |
| Min. Force | 97.8 N | 250.9 N |
| Avg. Force | 123.9 N | 257.4 N |
| Std. Deviation (σ) | 11.95 N | 9.13 N |
| Avg. - 3σ | 88.05 N | 230 N |
| Minimum Requirement | 150 N | |
| Result | Fail | Pass |
| Necessary Deviation from Requirement | 80 N | N/A |

TABLE 2

USCAR 17 Sequence N - Mechanical Pull Test Results

| | Assembly 100 | Assembly 500 |
|---|---|---|
| # of Samples | 12 | 12 |
| # Passing | 3 | 12 |
| % Passing | 25% | 100% |

Figure 10A:
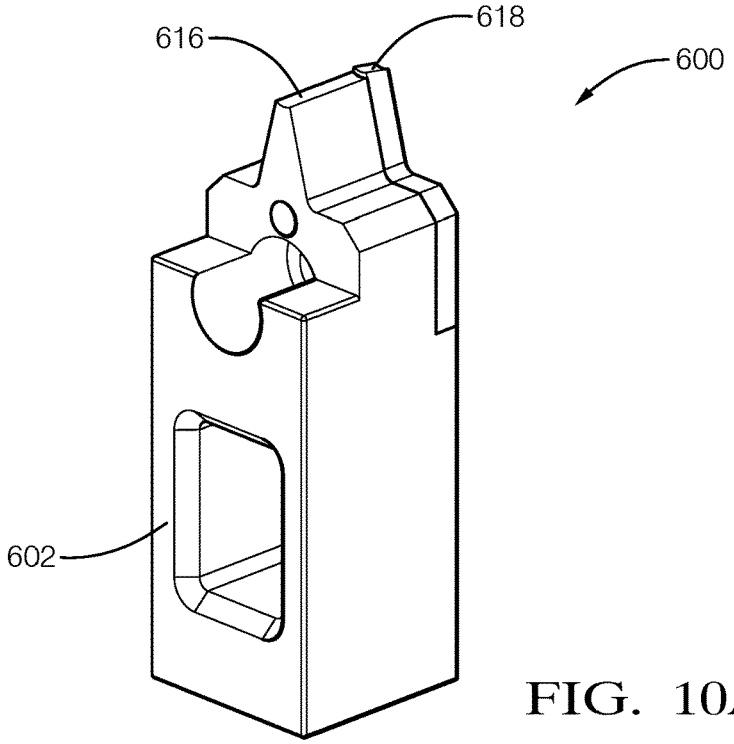
FIG. 10*a* is a perspective view of a crimping tool configured to form the indentation of FIG. 9 according to one embodiment.
Figure 10B:
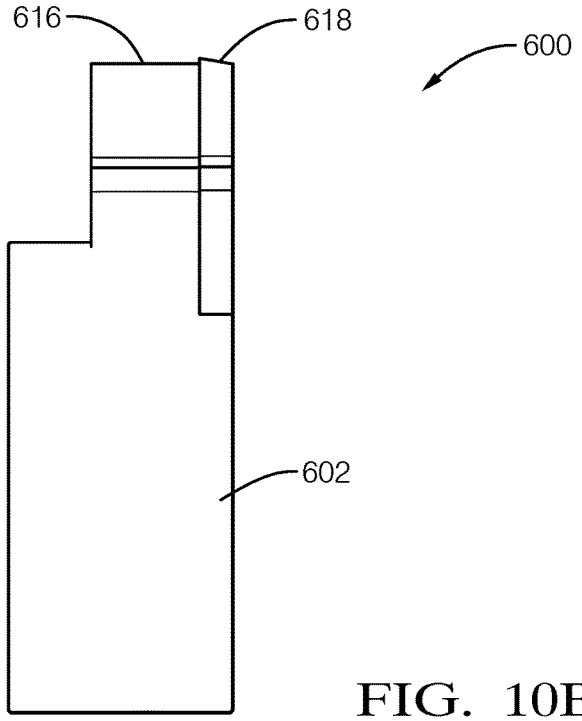
FIG. 10*b* is a side view of the crimping tool of FIG. 11*a* according to one embodiment.

FIGS. 10*a* and 10*b* illustrate another alternative embodiment of the crimping tool 600. Each of the four crimping dies 602 include a concave crimping surface 616 and a concave indentation surface 618 angled relative to the crimping surface 616. The concave crimping surface 616 and the concave indentation surface 618 have the same radius. An angle of the indentation surface 618 relative to the crimping surface 616 is in a range of 10 to 20 degrees, preferably 15 degrees.

Figure 11:
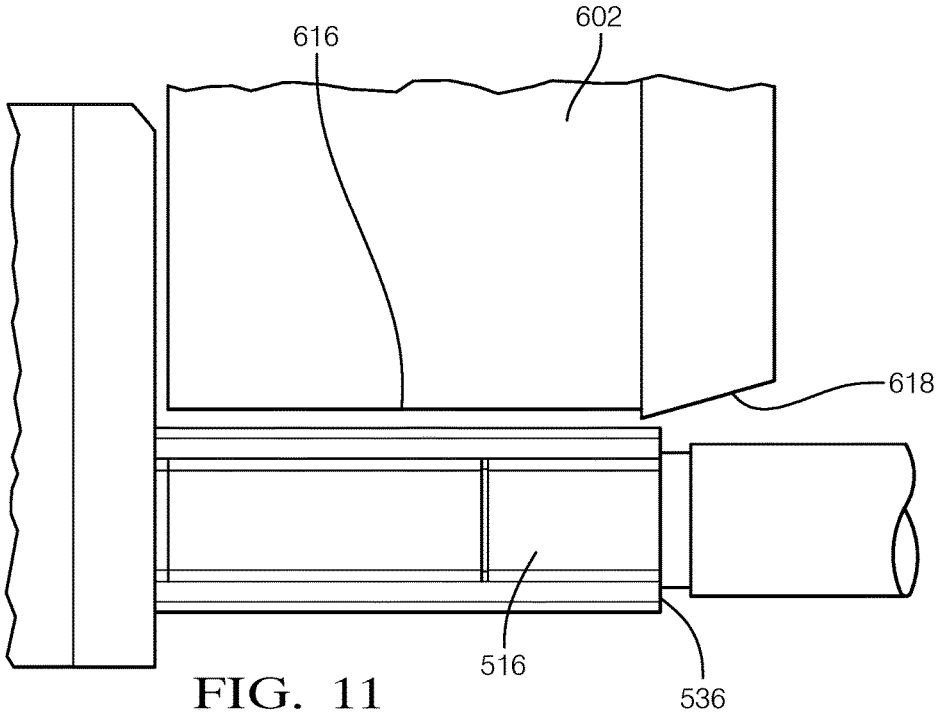
FIG. 11 is a side view of the tool of FIG. 10*a* in relation to the conductor assembly of FIG. 9 after forming the indentation according to one embodiment.

As shown in FIG. 11, the indentation surface 618 is placed near the distal edge 536 of the outer ferrule 516 as the crimping die 602 is applied to the outer ferrule 516.

Figure 12:
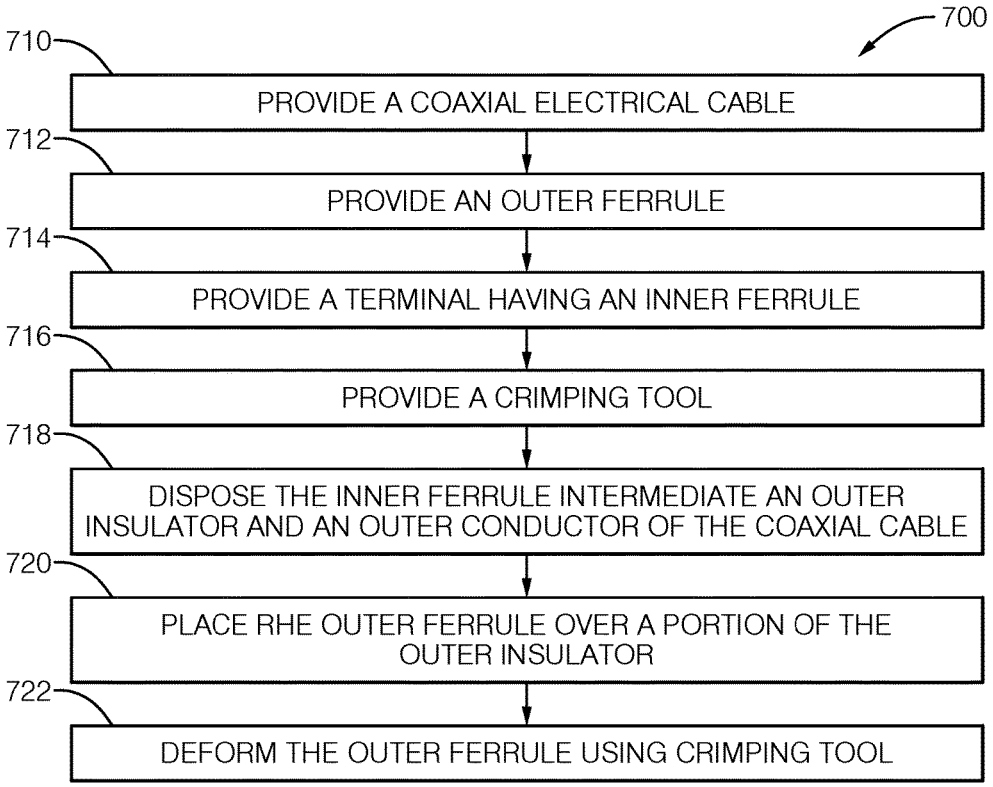
FIG. 12 is a flow chart of a method of manufacturing the conductor assemblies of FIG. 1, 3, or 9 using the crimping tool of FIG. 4, 7, or 10*a-b* according to one embodiment.

FIG. 12 describes a method 700 of manufacturing the coaxial cable assembly 100, 500 described above. The method 700 includes the following steps:

STEP 710, PROVIDE A COAXIAL ELECTRICAL CABLE, includes providing a coaxial electrical cable 102 comprising a central inner conductor 104, an inner insulator 106 surrounding the inner conductor 104, an outer conductor 108 surrounding the inner insulator 106, and an outer insulator 110 surrounding the inner insulator 106;

STEP 712, PROVIDE AN OUTER FERRULE, includes providing a generally cylindrical seamless outer ferrule 116 having a ferrule radius 124;

STEP 714, PROVIDE A TERMINAL HAVING AN INNER FERRULE, is an optional step that includes providing a terminal having an inner ferrule 114;

STEP 716, PROVIDE A CRIMPING TOOL, includes providing a crimping tool 300 including four crimping dies 302 each having a die face 304 defining a consistent depression radius 312 that is less than the ferrule radius 124;

STEP 718, DISPOSE THE INNER FERRULE INTERMEDIATE AN OUTER INSULATOR AND AN OUTER CONDUCTOR OF THE COAXIAL CABLE, is an optional step that includes disposing the inner ferrule 114 intermediate the outer insulator 110 and the outer conductor 108 prior to STEP 722, DEFORM THE OUTER FERRULE USING THE CRIMPING TOOL;

STEP 720, PLACE THE OUTER FERRULE OVER A PORTION OF THE OUTER INSULATOR, includes placing the outer ferrule 116 over a portion of the outer insulator 110; and STEP 722, DEFORM THE OUTER FERRULE USING THE CRIMPING TOOL, includes deforming the outer ferrule 116 using the crimping tool 300, 400, 600 to form four depressions 118 and four protrusions 120 in the outer ferrule 116 that are evenly spaced about a circumference of the outer ferrule 116. The outer ferrule 116 is held between the four crimping dies 302 so that the longitudinal axis of the outer ferrule 116 is substantially coincident with the longitudinal axis of the crimping tool 300. The four crimping dies 302 are brought simultaneously toward the longitudinal axes to provide substantially consistent pressure and deformation rates when forming the four depressions 118 and the four protrusions 120. The four depressions 118 each are characterized as having the depression radius 122. STEP 722 may further include deforming the four depressions 518 to form four indentations 532. Each indentation 532 has an indentation surface that is angled relative to an outer surface of each of the four depressions 518. Each indentation 532 forms a barb that at least partially penetrates the outer insulator 110.

The four crimping dies 302 are spaced approximately 90 degrees apart about the longitudinal axis of the crimping tool 300. After deformation of the outer ferrule 116, adjacent depressions 118 of the four depressions 118 are spaced approximately 90 degrees apart about the longitudinal axis of the outer ferrule 116. One of the four protrusions 120 is located intermediate the adjacent depressions 118. Adjacent protrusions 120 of the four protrusions 120 are spaced approximately 90 degrees apart about the longitudinal axis of the outer ferrule 116.

Accordingly, a coaxial electrical cable assembly 100 is provided. The consistent radius of the depressions 118 and the limited height 128 of the protrusions 120 reduces the variation in capacitance between the inner and outer conductors 104, 110 of the coaxial cable 102 in the area of the outer ferrule 116, thereby reducing the variation of impedance along the coaxial cable assembly 100 which provides improved insertion loss performance. The outer ferrule 516, as formed with the four depressions 518, four protrusions 520 and four indentations 532, also provides improved retention of the outer ferrule 516 to the coaxial cable assembly 100. The outer ferrule 516, as formed with the four depressions 118 and four protrusions 120, is also more easily accommodated into existing connector body designs having generally cylindrical connector cavities in which the coaxial cable assembly 100 is received.

Accordingly, a crimping tool 300 configured to form the four depressions 118 and four protrusions 120 in the outer ferrule 116 is also provided. The tool 300 includes four crimping dies 302 to form the four depressions 118 in the outer ferrule 116. The tool 300 also inclines four limiting dies 306 that limit growth of the four protrusions 120 so that the four protrusions 120 do not exceed a maximum height threshold 130. The crimping tool 300, when used with the outer ferrule 116, provides all of the benefits listed above.

The example presented herein is directed to a coaxial electrical cable assembly 100, however other embodiments may be envisioned that are adapted for use with other types of shielded or unshielded electrical cables. Yet other embodiments of the assembly may be envisioned wherein the conductors are fiber optic cables, pneumatic tubes, or hydraulic tubes.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

We claim:

1. A cable assembly, comprising:

an electrical cable comprising an elongate conductor surrounded by an outer insulator; and a generally cylindrical seamless outer ferrule having a ferrule radius surrounding a portion of the conductor, wherein the outer ferrule is deformed to define four indentations and four projections evenly spaced about a circumference of the outer ferrule, wherein the four indentations have a consistent indentation radius less than the ferrule radius;

a barb formed in an outer surface of at least one of the four indentations, wherein the barb is angled relative to the outer surface and at least partially penetrating the outer insulator.

2. The cable assembly according to claim 1, wherein the barb is located adjacent a distal edge of the outer ferrule.

3. The cable assembly according to claim 1, wherein the barb is angled relative to the outer surface is in a range of 10 to 20 degrees.

4. The cable assembly according to claim 1, wherein the four indentations each have a convex bottom surface with a radius that is less than the ferrule radius, and wherein the barb is formed in each of the convex bottom surfaces.

5. The cable assembly according to claim 4, wherein centers of adjacent indentations of the four indentations are spaced approximately 90 degrees apart around a longitudinal axis of the outer ferrule and wherein one of the four protrusions is located intermediate the adjacent indentations, wherein centers of adjacent protrusions of the four protrusions are spaced approximately 90 degrees apart around the longitudinal axis of the outer ferrule.

6. The cable assembly according to claim 5, wherein a portion of the outer ferrule retains the ferrule radius after deformation.

7. The cable assembly according to claim 5, wherein the electrical cable is a coaxial electrical cable comprising a central inner conductor, an inner insulator surrounding the inner conductor, an outer conductor surrounding the inner insulator, and the outer insulator surrounding the outer conductor.

8. The cable assembly according to claim 7, further comprising an inner ferrule that is disposed intermediate the outer conductor and the inner insulator.

9. The method of manufacturing a coaxial cable assembly comprising the steps of:

providing a coaxial electrical cable comprising a central inner conductor, an inner insulator surrounding the inner conductor, an outer conductor surrounding the inner insulator, and an outer insulator surrounding the outer conductor;

providing a generally cylindrical seamless outer ferrule having a ferrule radius;

providing a crimping tool including four crimping dies each having a first die face defining a consistent indentations radius that is less than the ferrule radius and a second die face that is angled relative to the first die face;

placing the outer ferrule over a portion of the outer insulator;

deforming the outer ferrule using the crimping tool to form four indentations and four protrusions in the outer ferrule that are evenly spaced around a circumference of the outer ferrule, wherein the four indentations each are characterized as having the indentations radius; and forming a barb in an outer surface of at least one of the four indentations, the barb having a barb surface that is angled relative to the outer surface the barb at least partially penetrating the outer insulator.

10. The method according to claim 9, wherein the barb is located adjacent a distal edge of the outer ferrule.

11. The method according to claim 9, wherein an angle of the barb surface relative to the outer surface is in a range of 10 to 20 degrees.

12. The method according to claim 9, wherein centers of adjacent indentations of the four indentations are spaced approximately 90 degrees apart around a longitudinal axis of the outer ferrule, wherein one of the four protrusions is located intermediate the adjacent indentations, and wherein centers of adjacent protrusions of the four protrusions are spaced approximately 90 degrees apart around the longitudinal axis of the outer ferrule.

13. The method according to claim 9, further comprising the step of:

forming four barbs in an outer surface of each of the four indentations, each barb of the four barbs having a barb surface that is angled relative to the outer surface and each of the four barbs at least partially penetrating the outer insulator.

14. A tool configured to form four evenly spaced indentations having an indentations radius and four evenly spaced protrusions around a circumference of a generally cylindrical seamless ferrule having a ferrule radius, said tool further configured to form four barbs in an outer surface of each of the four indentations, each barb of the four barbs having a barb surface that is angled relative to the outer surface, said tool comprising:

four crimping dies, each crimping die of the four crimping dies defining a concave crimping surface having the indentations radius and a concave barb surface angled relative to the crimping surface, said indentation surface also having the indentations radius; and four limiting dies, each limiting die located intermediate two adjacent crimping dies of the four crimping dies and defining a limiting surface configured to limit a height of each protrusion.

15. The tool according to claim 14, wherein adjacent crimping dies are spaced approximately 90 degrees apart around a longitudinal axis and wherein adjacent limiting dies of the four limiting dies are spaced approximately 90 degrees apart around the longitudinal axis.

16. The tool according to claim 14, wherein the four limiting dies are fixed such that each limiting surface remains at the limiting distance as the four crimping dies move relative to the longitudinal axis of the outer ferrule.

17. The tool according to claim 14, wherein the tool further comprises four linkages between each crimping die and an adjoining limiting die, said four linkages configured to move each limiting surface of each limiting die to the limiting distance as the four crimping dies move toward the longitudinal axis of the outer ferrule.

* * * * *